United States Patent [19]

Kecskeméthy et al.

[11] 4,163,511

[45] Aug. 7, 1979

[54] DISPENSER HAVING MANUALLY OPERATED AIR CONTROLLED VALVES

[75] Inventors: Geza Kecskeméthy; György Viràg; Robert Tihanyi, all of Budapest; Zoltán Czirmai, Tatabanya, all of Hungary

[73] Assignee: Muanyagipari Kutato Intezet, Budapest, Hungary

[21] Appl. No.: 795,234

[22] Filed: May 9, 1977

[51] Int. Cl.[2] ..... B67D 5/60

[52] U.S. Cl. ..... 222/144.5; 251/25

[58] Field of Search ..... 222/144.5, 145; 251/63.6, 25; 137/885

[56] References Cited

U.S. PATENT DOCUMENTS

| | | | |
|---|---|---|---|
| 3,118,610 | 1/1964 | Techler | 222/144.5 X |
| 3,664,552 | 5/1972 | Carse | 222/144.5 |
| 3,784,153 | 1/1974 | Ross et al. | 251/25 |
| 3,933,338 | 1/1976 | Herd et al. | 251/63.6 |

*Primary Examiner*—Stanley H. Tollberg
*Attorney, Agent, or Firm*—Young & Thompson

[57] ABSTRACT

Method and apparatus for dispensing material from a hand-held gun connected by a flexible conduit to a source of the material under pressure. The control of material flow is effected by a valve in series between the flexible conduit and the source of material, and hence remote from the gun, thereby to reduce the weight of the gun and to provide a gun that has no moving parts for controlling material flow. One or more orifices is provided in the handle of the gun for the continuous discharge of low pressure control air that actuates the valve or valves; and the selective opening or closing of the orifice or orifices by the hand or fingers of the operator, thus controls the valve or valves and hence the flow of material for materials to the gun. The invention is particularly useful for dispensing synthetic resins, which may require the provision of separate streams of resin, catalyst or hardening the resin, compressed air for atomizing the resin-catalyst mixture, chopped glass fiber, compressed air for actuating the glass fiber chopper, and solvent for flushing the mixing chamber of the gun.

2 Claims, 3 Drawing Figures

DISPENSER HAVING MANUALLY OPERATED AIR CONTROLLED VALVES

The present invention relates to a method and apparatus for dispensing fluids, more particularly by a hand-held gun in the nature of a spray gun, for example of the type for dispensing synthetic resins.

It is well known that in such cases, a dispenser that is held in the hand is used. The dispenser is commonly referred to as a gun and is connected through flexible hoses to receptacles from which one or more components to be dispensed, perhaps also with an atomizing airstream, are fed to the gun under positive pressure.

Such guns are known heretofore incorporate a valve or valve system which is usually mechanically operated. The operation of the valve permits dispensing of one or more components, which may for example include synthetic resins, a catalyzer or hardener for the resin, a dyestuff, and compressed air to atomize the dispensed liquids. In certain cases, two or more valves may be provided, for example when chopped glass fiber is dispensed in combination with a synthetic resin, in which case valving must be provided for the resin, for the catalyzer, for the atomizing air, and for compressed air that actuates the glass fiber chopper.

The valve arrangements in guns known heretofore have substantial drawbacks, since the valves are rather complicated and increase the weight of the guns. In order to be able to reduce weight, it has been proposed to miniaturize the valves; but this decreases the useful life and operational reliability of the gun. Problems are also encountered in connection with the sealing of the valves, due in part to the need to keep the guns small and light in weight. If the valves are unreliable, the dispensed material may contact the skin of the operator, with undersirable results.

Also, when a pigment or pigmented resin is dispensed, a problem arises when it is desired to change the color of the dispensed material. Due to their complicated construction, simple flushing of the valves is impossible. Therefore, when changing a dyestuff of different color, the whole gun must be disassembled.

Finally, the physical effort of actuating valves on guns as known heretofore, over long periods of time, can be quite tiring to the operator, particularly when plural valves are involved.

Accordingly, it is an object of the present invention to provide a method and apparatus for dispensing fluid from such a gun, in which the above drawbacks are overcome.

The present invention comprises the recognition that the valves for the material or materials to be dispensed need not be carried by the gun itself but can be spaced from the gun on stationary equipment associated with the gun, and that the valves can be actuated by means of pneumatic inpulses originating at the gun and being conveyed via small-diamter conduits of the valves. These pneumatic impulses can be controlled by the hand or the fingers of the operator, by opening or closing one or more orifices on the gun through which air passes, these orifices being thus control orifices for the flow of air through the small diameter conduits.

As indicated above, the number of the orifices can be variable. A single orifice can control one component or a plurality of components to be dispensed. Alternatively, when these are a plurality of components to be dispensed, there can be an orifice on the gun individual to each component. Still further, when plural components are dispensed, there can be an orifice individual to one or more of the components and one or more orifices that control jointly a plurality of the components. By "components", as indicated above, is meant gaseous, liquid and solid components, the gaseous component ordinarily being air, the liquid components being, for example, synthetic resin, hardener or catalyst for the same, dyestuffs, flushing solvents, etc., and the solid component often being chopped glass fiber. As indicated above, the orifices can also control the actuation of the chopper for glass fiber, for example by control of a stream of compressed air that operates the chopper.

The orifices can be directly opened or closed by the fingers or hand of the operator; alternatively, they can be indirectly opened or closed by means of keys operated by the fingers or hand of the operator, much in the manner of a woodwind musical instrument.

These and other objects, features and advantages of the present invention will become apparent from a consideration of the following description, taken in connection with the accompanying drawings, in which.

Figure 1:
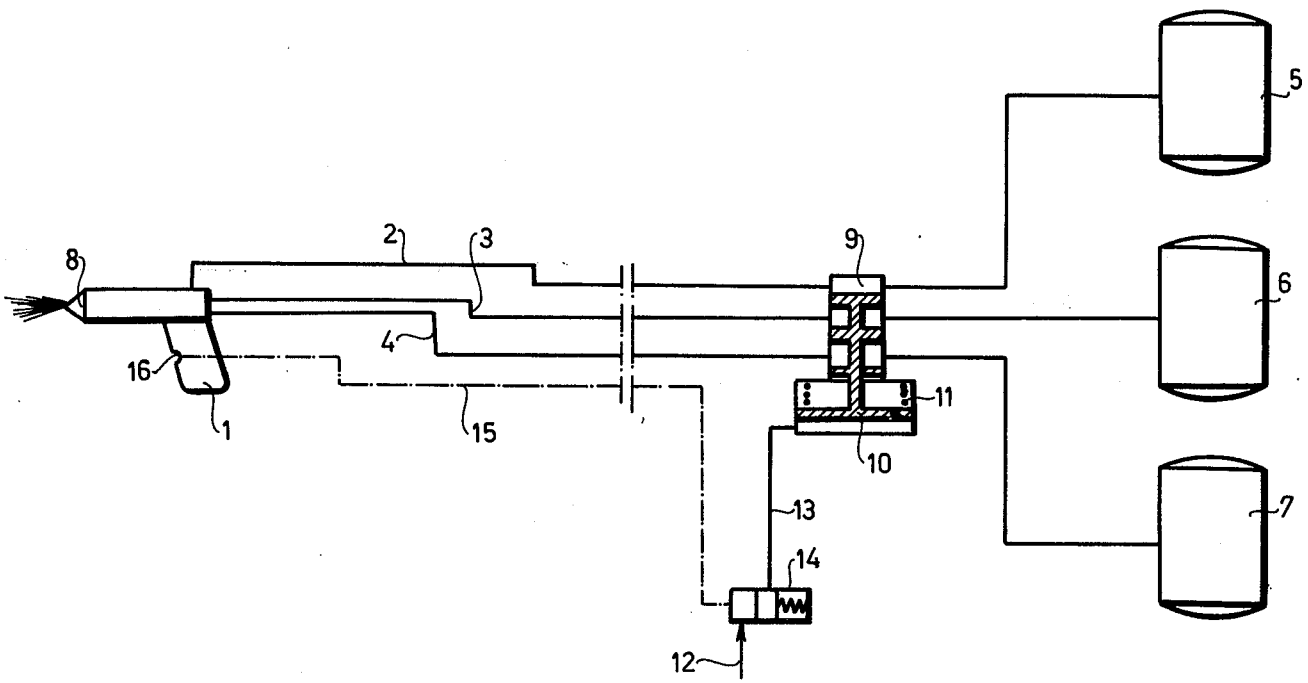
FIG. 1 is a schematic view of a system for dispensing plural materials according to the present invention.

Referring now to the drawings in greater detail, and first to FIG. 1, there is shown apparatus according to a first embodiment of the invention, comprising a hand-held gun 1 in the nature of a spray gun, connected via flexible conduits 2, 3 and 4 to receptacles 5, 6 and 7, respectively, which hold the various gases and/or liquid components to be dispensed under positive pressure, from the dispensing end 8 of the gun 1.

According to the present invention, a valve 9 is provided whose movable valve element 10 is urged by coil compression spring 11 toward the position shown in FIG. 1, in which valve 9 closes all of conduits 2, 3 and 4.

Compressed air may be supplied via conduits 12 and 13 to valve 9 to move element 10 against the action of spring 11 to a position in which conduits 2, 3 and 4 are all simultaneously opened and simultaneously feed material to be dispensed from gun 1. However, a valve 14 is interposed between conduits 12 and 13; and conduit 12 is continuously in communication via valve 14 with a small diameter conduit 15 that terminates in a small orifice 16 that opens through the handle of gun 1.

Compressed air from conduit 12 continuously bleeds through conduit 15 and out orifice 16, so that the pressure in valve 14 does not rise high enough to open valve 14 so long as orifice 16 is open. But when orifice 16 is closed, as by the hand or finger of an operator, then the bleed through conduit 15 is terminated and the pressure in valve 14 builds up to the point that valve 14 opens communication between conduits 12 and 13, thereby to actuate valve 9 to dispense the materials from conduits 2, 3 and 4. In this sense, therefore, valve 14 can be considered a pneumatic-sensing element, or sensing and amplifying unit.

Apart from the structure 9–16, the system of FIG. 1 can be entirely conventional.

Figure 2:
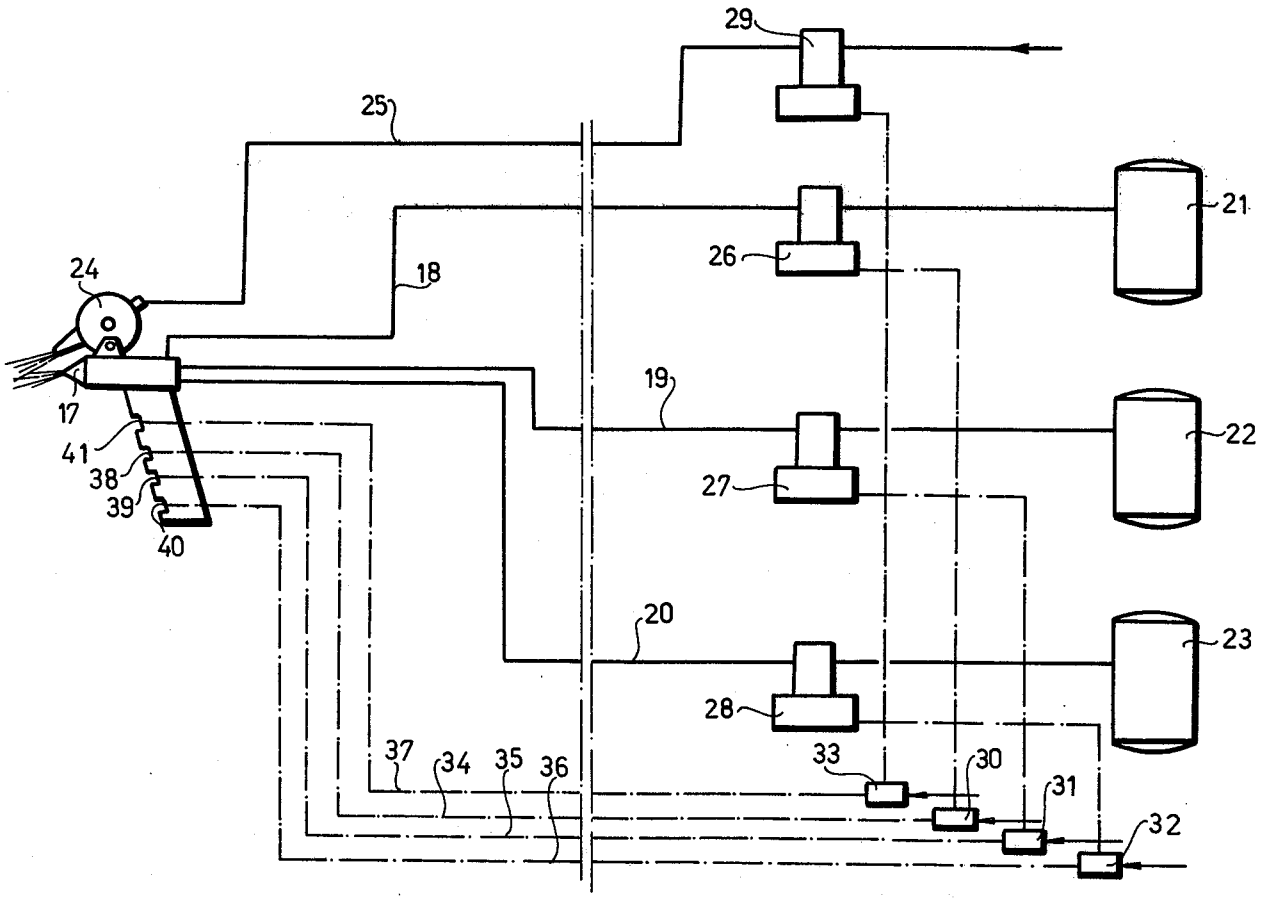
FIG. 2 is a view similar to FIG. 1, but showing a modified form of the invention.

FIG. 2 shows a modified form of system embodying the present invention, in which a gun 17 dispenses three fluids via flexible conduits 18, 19 and 20, from receptacles 21, 22 and 23, respectively. In addition, glass fiber is dispensed for admixture with the other components, one of which is, for example, polyester resin, from a glass fiber chopper 24 actuated by compressed air from a flexible conduit 25.

In the embodiment of FIG. 2, however, in contrast to that of FIG. 1, it is desired selectively individually to control the flow of the dispensed components. To this end, therefore, each of conduits 18, 19, 20 and 25 is provided with an individual valve 26, 27, 28 and 29, respectively, which are similar in construction to valve 9 except that there is only one through passage because there is only one element to be controlled per valve.

Pneumatic sensing valves 30, 31, 32 and 33 are provided, one individual to each valve 26–29, respectively, the valves 30–33 being for example each identical in construction to valve 14 of FIG. 1 and operating in the same manner, each from its supply of compressed air that bleeds through a respective small flexible conduit 34–37 to a respective orifice 38–41 on the handle of gun 17.

Needless to say, the valves 9 and 26–29 could be arranged in reverse configuration, so that the application of pneumatic pressure thereto moves them from the open to the closed position. In that case, of course, dispensing would take place when the orifice or orifices on the gun handle are open and would be terminated by closing the orifice or orifices.

Figure 3:
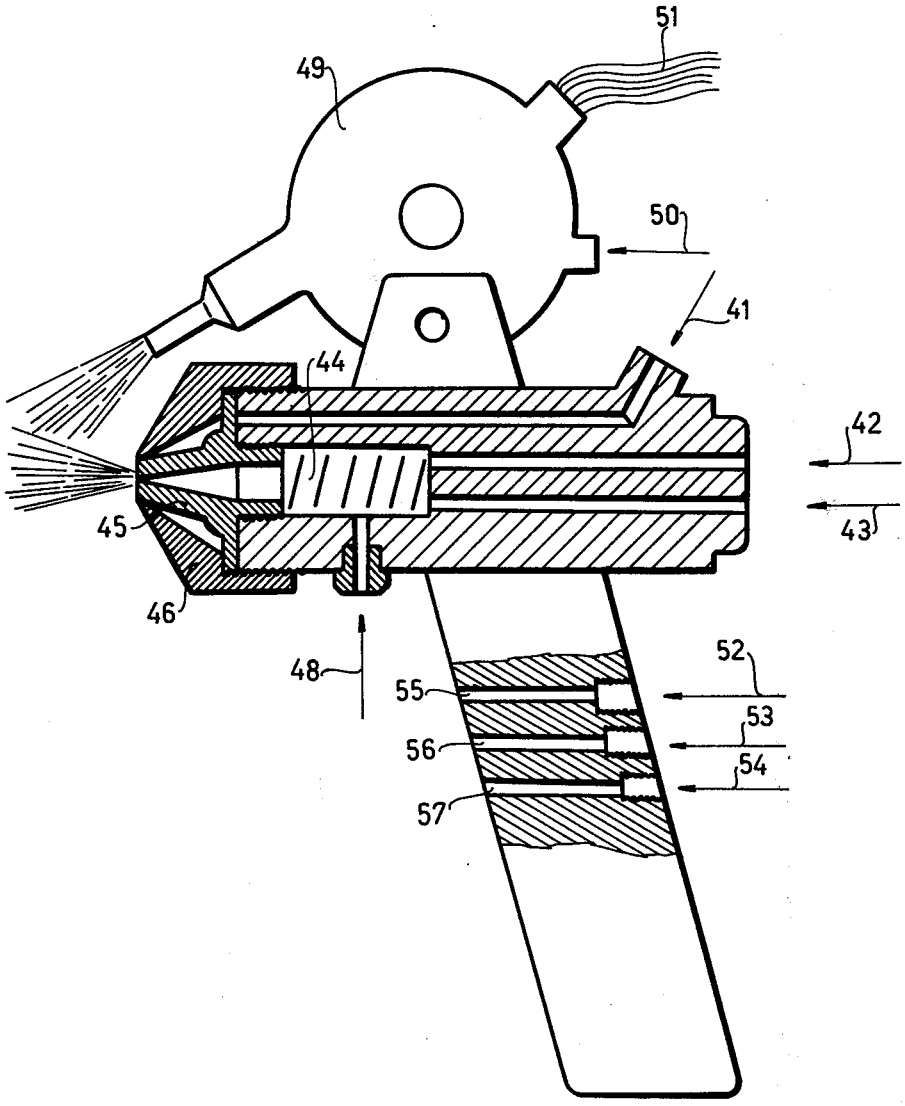
FIG. 3 is an enlarged cross-sectional view of a hand-held gun for practicing an embodiment of the invention.

FIG. 3 shows in greater detail a gun for dispensing synthetic resins such as polyester resin and chopped glass fiber. Apart from the conduits and orifices on the handle, the gun is of conventional construction and is provided with passageways for the separate introduction of a stream 42 of polyester resin and a stream 43 of catalyst therefor, into the mixing chamber 44 of the gun and for the dispensing of the mixed resin and catalyst through a nozzle 45 that is surrounded by a conventional air cap 46 fed by a stream 47 of compressed air. A stream 48 of solvent can be provided, as usual, for flushing out mixing chamber 44 to prevent the buildup therein of mutually reactive materials at the end of dispensing.

A glass fiber chopper 49 is actuated by a stream 50 of compressed air thereby to chop into short lengths glass fiber sliver or roving 51 that is supplied to chopper 49, all in a conventional manner.

According to the present invention, individual streams of compressed air 52, 53 and 54 are bled via individual flexible conduits, as in FIG. 2, to and through small orifices 55, 56 and 57, respectively, in the handle of the gun. However, FIG. 3 illustrates the instance in which some of the orifices are individual to a single fluid stream while another of the orifices is common to a plurality of streams. Specifically, in the FIG. 3 arrangement, the orifice 55 with its corresponding stream 52 of compressed air is individual to the control of the stream 48 of flushing solvent. The orifice 56 is individual to the stream of compressed air 50 that operates glass fiber chopper 49; and the orifice 57 jointly controls the streams 42, 43 and 47 of resin, catalyst and compressed air, respectively, that flow through the gun. Thus, by selective individual opening and closing of the orifices 55–57, it is possible selectively to dispense mixed atomized resin and catalyst, with or without chopped glass fiber, and thereafter to flush the mixing chamber with solvent.

An advantage of the present invention is that the supply of controlled compressed air, for example via conduit 12, need be only at very low pressure, for example, 0.01–0.1 atmosphere of positive pressure. Thus, the consumption of compressed air for this purpose is negligible. Moreover, as the valves 12 and 30–33 can be constructed to be quite sensitive, it is not necessary completely to close the orifices on the gun handle: it suffices merely to choke or impede the opening thereby to alter the back pressure of the controlled compressed air to a sufficient degree. As indicated above, this control can be performed directly by the hand or fingers of the operator, or indirectly via keys.

Also, although fully pneumatic systems have been disclosed above, it is to be recognized that electropneumatic variations can also be resorted to.

An important advantage of the present invention is that it is easy to change colors of the dispensed material. Thus, if for example various dyestuffs are employed, then it is an easy matter to provide an individual conduit with an individual valve for each individual receptacle of dyestuff or resin containing dyestuff, or a different color. It is thus not necessary to clean the valves, because the valves are always immersed in material of the same color. It suffices merely to flush the mixing chamber and then to start with a new color by the technique of manipulating a different set of orifices.

It will thus be recognized that the present invention has, among others, the following advantages:

1. Compared to known spray guns and the like, the weight can be greatly reduced, for example, by 40 to 60%.

2. As the valves can be mounted remote from the gun on some fixed portion of the apparatus, it is possible to construct the valves quite strongly and so they operate with greatest safety and reliability.

3. The use of impulse air for operating the valves according to the present invention is much quicker than manual operation as heretofore performed.

4. The hand-held gun operates quite reliably, because it need have no moving parts.

5. Operation of the gun is much easier, because the work of manually opening and closing valves is not required.

6. The flexible conduits between the gun and the stationary control valves are not under pressure when the gun is out of operation; and this is quite important for safety purposes and also to ensure long life of the conduits.

7. As indicated above, it is quite easy to change colors quickly and easily.

To enable those skilled in the art to practice the invention, the following illustrative examples are given:

EXAMPLE 1

A spray gun according to FIG. 3 is used, for dispensing mixed polyester resin and catalyst therefor at a rate of 5 kilograms per minute. The orifices in the handle have a diameter of 1.5 mm; the inside diameter of the small conduits for the impulse or pressure air is 1 mm, and the pressure of the impulse or control air is 15.2 psia, which is 0.5 psig, or about 0.034 atmosphere. The resin and catalyst are delivered to the gun under a pressure of 158 psig, and the pressure of the compressed air both to the gun and to the glass fiber chopper is 100 psig. Flushing solvent is delivered at a pressure of 72 psig. The weight of the gun is about half that of guns known heretofore for similar purposes and of the same capacity.

EXAMPLE 2

A gun is provided for spraying polyester gel resins selectively individually in the colors red, green and yellow, the resin component in each case being pigmented. Thus, there are three storage containers for resins, one for red, one for green, and one for yellow, as well as a storage container for catalyzer and a source of compressed air, as well as a source of solvent under pressure. Four orifices are provided on the gun handle. When one of these orifices is closed, red resin plus catalyzer plus compressed air are dispensed. Closure of the second orifice dispenses yellow resin plus catalyzer plus compressed air; while closure of the third orifice dispenses green resin plus catalyzer plus compressed air. The fourth orifice controls only the solvent flush, and is selectively closed in the interim between closure of two different ones of the other orifices, thereby to flush the mixing chamber when changing colors.

From a consideration of the foregoing disclosure, therefore, it will be evident that the initially recited object of the present invention has been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In an apparatus for dispensing material, comprising a hand-held dispenser connected by at least one flexible conduit to plural sources of material under pressure to be dispensed, and valve means for selectively opening and closing said conduit to the flow of said material therethrough, said valve means being disposed in series between said flexible conduit and said sources, and means carried by said dispenser for selectively actuating said valve means; the improvement in which said actuating means comprises orifices on said dispenser that may be selectively opened or closed by the operator, small conduits interconnecting said orifices with a source of air under pressure, one said conduit being individual to each said orifice for the separate control of the flow of at least one said material to said dispenser, and means responsive to a change in pressure in any said small conduit upon opening or closing the associated one of said orifices, to actuate said valve means, said dispenser comprising a spray gun having a handle, said orifices opening through the surface of said handle.

2. Apparatus as claimed in claim 1, said handle being vertically elongated and said orifices being disposed in a vertically spaced series along the front of the handle.

* * * * *